United States Patent [19]

Grolms

[11] 4,271,602

[45] Jun. 9, 1981

[54] AIR NOZZLE FOR A JET DRYER

[75] Inventor: Friedbert Grolms, Neuss, Fed. Rep. of Germany

[73] Assignee: Jagenberg Werke Aktiengesellschaft, Düsseldorf, Fed. Rep. of Germany

[21] Appl. No.: 66,589

[22] Filed: Aug. 14, 1979

[30] Foreign Application Priority Data

Aug. 17, 1978 [DE] Fed. Rep. of Germany ..... 2836103

[51] Int. Cl.[3] ..... F26B 13/02

[52] U.S. Cl. ..... 34/160; 34/155; 239/553.5; 239/561; 239/568

[58] Field of Search ..... 34/155, 156, 160; 239/553.5, 556, 560, 561, 568; 226/97

[56] References Cited

U.S. PATENT DOCUMENTS

| | | | |
|---|---|---|---|
| 3,549,070 | 12/1970 | Frost | 34/156 |
| 3,763,571 | 10/1973 | Vits | 34/156 |
| 3,873,013 | 3/1975 | Stibbe | 34/156 |
| 3,943,639 | 3/1976 | Vits | 239/560 |
| 4,074,841 | 2/1978 | Kramer et al. | 34/156 |
| 4,155,178 | 5/1979 | Weldon | 34/156 |

*Primary Examiner*—Larry I. Schwartz

*Attorney, Agent, or Firm*—Sprung, Felfe, Horn, Lynch & Kramer

[57] ABSTRACT

An air nozzle for a jet drier has a nozzle slot extending transverse to a moving material web during use and has an elongated nozzle lip which together with the material web forms the boundary of a channel for drying air. The elongated nozzle lip has a planar portion and at least one stabilizing zone for the drying air which extends over the entire width of the nozzle and which interrupts the planarity of the planar portion of the nozzle lip. Each stabilizing zone includes equalizing openings, so spaced from the nozzle slot that stabilization of the flow is assured with widely varying drying air velocities.

9 Claims, 4 Drawing Figures

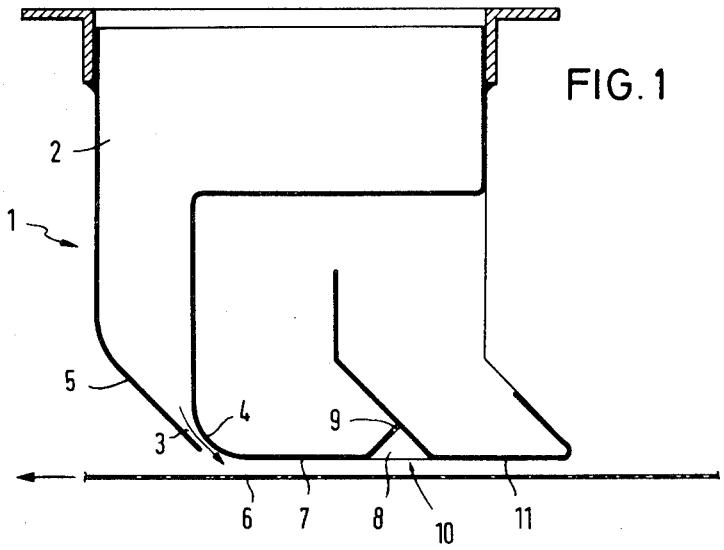
FIG. 1
FIG. 2
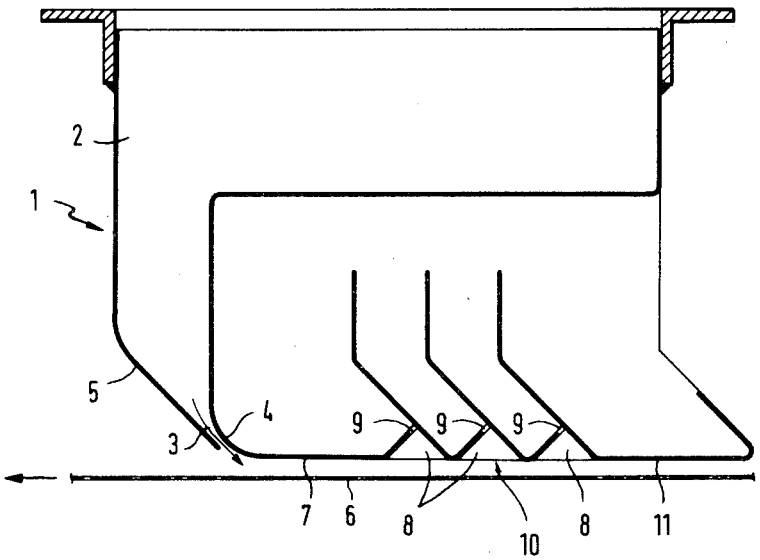

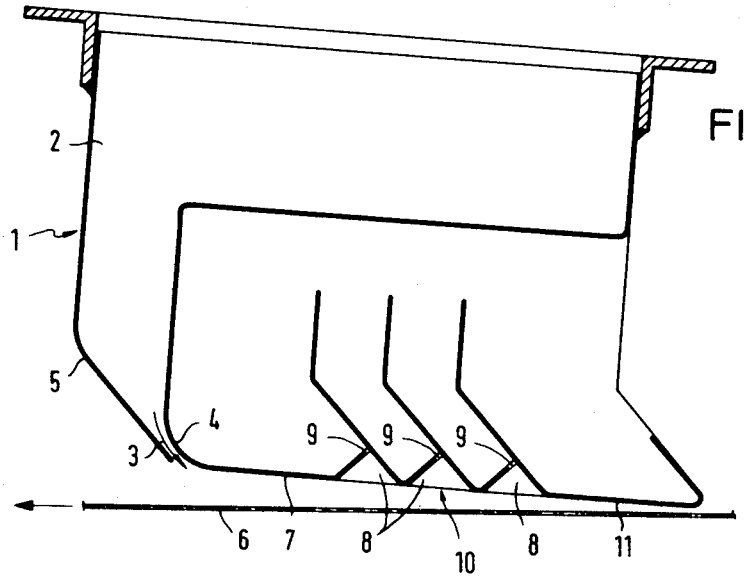
FIG. 3
FIG. 4
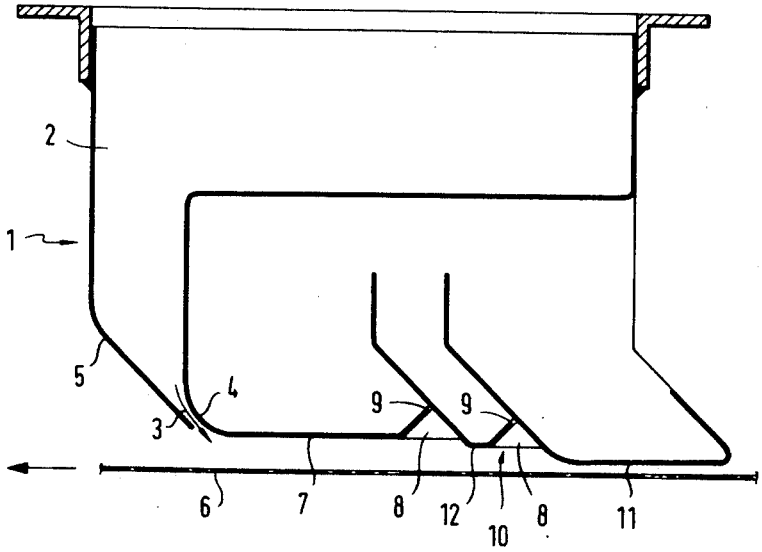

AIR NOZZLE FOR A JET DRYER

BACKGROUND OF THE INVENTION

The invention relates to an air nozzle for a jet dryer for the drying of moving material webs of textiles or the like, constructed as a slot nozzle with a nozzle slot extending transverse to the moving material web and having an elongated nozzle lip which, together with the material web moving substantially parallel alongside it, forms over a considerable length the boundary of the channel for the drying air.

An air nozzle of this type for example is known from published examined German patent application 21 56 100. In such prior art air nozzles the air exits from the nozzle slot along a curved surface utilizing the Coanda effect. Downstream of the curved surface the air stream enters a channel bounded on one side by the elongated nozzle lip and on the other side by the moving material web.

For optimum utilization of the drying air, the flow channel, and hence the elongated nozzle lip, heretofore had to be made relatively long with high air velocity and this could result in an undesired fluttering of the material web. The cause of this fluttering lies in pressure variations in the channel flow due to friction with the flow channel walls. These pressure variations result in a pulsating air stream and hence in a fluttering of the material web. Heretofore such fluttering could be avoided or minimized only by increasing the tension of the material web, which, however, is neither desirable nor possible with all materials.

SUMMARY OF THE INVENTION

The object of the invention is to provide an air nozzle of the type described above which assures smooth travel of the material even with widely varying drying-air velocities and low material tension along with optimum utilzation of the drying air before it exits from the air nozzle and good heat transfer when the dryer is operated with hot gases.

In accordance with the invention, this object is accomplished in that the elongated nozzle lip has at least one stabilizing zone for the drying air which extends over the entire width of the nozzle, interrupts the nozzle lip, and is provided with equalizing openings, so spaced from the nozzle slot that stabilization of the flow is assured with widely varying drying-air velocities.

With this arrangement, every channel flow zone is followed by a pressure equalization zone in which the air is calmed. Pressure equalization produces for the next channel flow zone a stabilization as well as a reapplication of the air jet. The drying air leaves the nozzle as a whole only after passing through two or more channel flow zones after optimum utilization.

The nozzle in accordance with the invention is constructed so that there can be no fluttering of the material web, regardless of air-flow velocity, while on the other hand the drying air is in every case held in contact with the material web sufficiently long for its drying capacity to be optimally utilized before it leaves the material web.

The length of the elongated nozzle lip between nozzle slot and stabilizing zone, and the length of the nozzle surface following the stabilizing zone, advantageously are each about 30 times the width of the nozzle slot. Such lengths positively prevent a fluttering of the material web even with widely varying flow velocities of the drying air.

The stabilizing zone advantageously consists of one or more recesses of triangular cross section extending parallel to the nozzle slot over the entire width of the nozzle, rounded transitions to the elongated nozzle lip and to the nozzle surface, and equalizing slots in the apexes of the recesses. The equalizing slots provide for pressure equalization and flow stabilization without appreciable amounts of drying air being lost to the outside. The rounded transitions provided assurance that no further turbulence distrubing the flow can occur between nozzle lip and stabilizing zone, and between stabilizing zone and nozzle surface, respectively.

Advantageously a stabilizing zone with three recesses is provided, and the length of the elongated nozzle lip upstream of the stabilizing zone and the length of the nozzle surface downstream of the stabilizing zone are about the same as that of the stabilizing zone. In this way an air nozzle of simple design is obtained which fully meets the requirements imposed on it, as mentioned above.

The plane of the elongated nozzle lip and of the nozzle surface downstream of the stabilizing zone may be inclined with the nozzle surface toward the moving material web. After the insurge of air, the elongated nozzle lip is farthest removed from the material web and the nozzle surface downstream of the stabilizing zone is closest to it. In this way a more pronounced injector effect is obtained as the air jet enters. Because of the enhanced injector effect, with constant exit velocity at the nozzle, a larger quantity of air is moved into the flow channel bounded by the elongated nozzle lip and the nozzle surface, respectively, and the material web. As a result, the nozzle lip is again spaced farther from the material web.

A similar effect may be obtained in accordance with another embodiment of the invention by locating the elongated nozzle lip before its interruption by the stabilizing zone farther from the material web than the nozzle surface following the stabilizing zone. Such stepping also produces a more pronounced injector effect as the air jet enters.

The bottom surfaces of the separating portions between a plurality of recesses in the stabilizing zone advantageously extend along the connecting plane between the end of the elongated nozzle lip and the beginning of the nozzle surface.

Finally, the edge of the nozzle surface at the outlet of the air nozzle is rounded. In this way the occurrence of further air turbulence is prevented also in the air nozzle outlet, and with it a disturbance of the air before it exits from the flow channel between air nozzle and material web.

Exemplified embodiments of the invention are shown in the drawings wherein:

BRIEF DESCRIPTION OF THE DRAWINGS

FIG. 1 is a longitudinal section through an exemplified embodiment of the air nozzle in accordance with the invention;

FIG. 2 is a longitudinal section as in FIG. 1 through a further exemplified embodiment of the air nozzle in accordance with the invention;

FIG. 3 is a longitudinal section through an air nozzle which is similar to FIG. 2 but is inclined relative to the material web; and FIG. 4 is a longitudinal section through a further exemplified embodiment of the air nozzle in accordance with the invention with a nozzle surface that is stepped relative to the elongated nozzle lip.

DETAILED DESCRIPTION OF THE INVENTION

The air nozzle shown in FIG. 1 has an air chamber 2 through which the drying air is conducted to a nozzle slot 3 which extends over the entire width of the air nozzle 1. The nozzle slot 3 is formed between a rounded wall 4 of the air chamber 2 and an inwardly bent plate 5 of the air chamber 2. The plate 5 extends substantially tangential to the rounded wall 4. On the underside of the air nozzle 1, the wall 4 passes into an elongated nozzle lip 7 extending parallel to the material web 6. The length L of the nozzle lip 7 is about 30 times the width W of the nozzle slot 3. Through the so-called Coanda effect, the material web 6 is held close to the nozzle lip 7. The material web travels counter to the direction of flow of the drying air.

Disposed at the end of the elongated nozzle lip 7 is a recess 8 of triangular cross section extending over the entire width of the air nozzle 1 and having an equalizing slot 9 which likewise extends transverse to the width of the nozzle. The recess 8 forms a stabilizing zone 10 for the drying air because it provides for pressure equalization through the equalizing slot 9. After leaving the stabilizing zone 10, the drying air enters, substantially without loss of air, a channel flow zone between the material web 6 and a further nozzle surface 11 having a length L' which is about 30 times the slot width W. The edges on the nozzle lip 7 and on the nozzle surface 11 are rounded to prevent the occurrence of further turbulence which might interfere with stabilization.

FIG. 2 shows another exemplified embodiment of an air nozzle 1 in which the stabilizing zone 10 has three recesses 8 arranged in a row. The length of the stabilizing zone 10 is approximately equal to the length of the elongated nozzle lip 7 and the length of the nozzle surface 11 downstream of the stabilizing zone 10. Apart from this, the design of the nozzle according to FIG. 2 corresponds to that of FIG. 1.

The air nozzle 1 shown in FIG. 3 is constructed similarly to the air nozzle 1 according to FIG. 2. However, the entire air nozzle is inclined in such a way that the plane of the elongated nozzle lip 7 and of the nozzle surface 11 forms an acute angle with the material web 6 so that the nozzle is spaced farthest from the material web 6 in the vicinity of the elongated nozzle lip 7. Through this design and arrangement of the air nozzle 1 a more pronounced injector effect is obtained as the air jet enters the channel between the moving material web 6 and the elongated nozzle lip 7 and the nozzle surface 11, respectively. Because of the enhanced injector effect, a larger quantity of air is moved into the flow channel, with constant exit velocity at the nozzle slot 3, and as a result the spacing of the elongated nozzle lip 7 from the material web 6 is increased. The material web 6 travels counter to the direction of flow of the drying air.

Finally, FIG. 4 shows a further exemplified embodiment of the air nozzle which has a more pronounced injector effect as the air jet enters. Here the elongated nozzle lip 7 and the nozzle surface 11 are so stepped relative to each other that the spacing between the extended nozzle lip 7 and the moving material web 6 is greater than the spacing between the nozzle surface 11 downstream of the stabilizing zone 10 and the material web. The effect is similar to that obtained with the nozzle arrangement shown in FIG. 3.

Moreover, as a modification of the air nozzle according to FIGS. 1 and 3, the stabilizing zone 10 here consists of only two recesses 8. The bottom surface of the separating portion 12 between the two recesses 8 is disposed at a level intermediate between the level of the elongated nozzle lip 7 and the nozzle surface 11 downstream of the stabilizing zone 10.

It should be understood that in place of just one nozzle surface 11 downstream of a stabilizing zone 10 there may be a plurality of nozzle surfaces 11, separated from one another by stabilizing zones 10. In any event, the arrangement of stabilizing zones extending over the entire width of the nozzle and followed by nozzle surfaces permits optimum utilization of the drying air and assures that the air nozzle can be used with widely varying air velocities.

It will be appreciated that the instant specification and claims are set forth by way of illustration and not limitation and that various changes and modifications may be made without departing from the spirit and scope of the present invention.

What is claimed is:

1. In an air nozzle of the slot nozzle type for a jet dryer for the drying of moving material webs, having a nozzle slot extending transverse to the moving material web during use and having an elongated nozzle lip which together with the material web moving substantially parallel thereunder during use forms, over a considerable length, the boundary of a channel for the drying air, the improvement wherein the elongated nozzle lip has a planar portion and at least one stabilizing zone for the drying air which extends continuously over the entire width of the nozzle and which interrupts the planarity of the planar portion of the nozzle lip to form first and second planar nozzle surfaces on either side thereof, wherein the nozzle slot is configured to direct drying air unidirectionally towards the planar nozzle surfaces and in counter-current to the movement of the web and wherein each stabilizing zone includes equalizing openings for drawing off a portion of the drying air, so spaced from the nozzle slot that stabilization of the drying air flow is assured with widely varying drying air velocities.

2. The air nozzle according to claim 1, wherein the length of the first and second planar nozzle surfaces are each about 30 times the width of the nozzle slot.

3. The air nozzle according to claims 1 or 2, wherein each stabilizing zone has at least one recess having a triangular cross section and extending over the entire width of the nozzle parallel to nozzle slot, rounded transitions to the first and second planar nozzle surfaces and wherein the equalizing openings comprise slots in the apexes of the recesses.

4. The air nozzle according to claim 3, wherein the stabilizing zone comprises three recesses and that the length of each of the first and second planar nozzle surfaces are approximately equal to that of the stabilizing zone.

5. The air nozzle according to claim 1, wherein the plane of the first and second planar nozzle surface is inclined with respect to the moving material web.

6. The air nozzle according to claim 3, wherein the first planar nozzle surface is upstream of the stabilizing zone and is disposed farther from the material web than the second planar nozzle surface downstream of the stabilizing zone.

7. The air nozzle according to claim 6, wherein the bottom surfaces of portions between the recesses of the stabilizing zone extend in a plane disposed between adjacent first and second planar nozzle surfaces.

8. The air nozzle according to claim 1 wherein the edge of the nozzle surface at the outlet of the channel is rounded.

9. The air nozzle according to claim 6, wherein the first and second planar nozzle surfaces are at different parallel planes and the bottom surfaces of the portion between the recesses of the stabilizing zone are at parallel planes intermediate the planes of the first and second planar nozzle surfaces.

* * * * *